US009792792B2

(12) United States Patent
Strassburger et al.

(10) Patent No.: US 9,792,792 B2
(45) Date of Patent: Oct. 17, 2017

(54) SECURITY TAG FOR WIRE HANDLE

(71) Applicant: B&G Plastics, Inc., Union, NJ (US)

(72) Inventors: Jake Strassburger, South Plainfield, NJ (US); Daniel V. Cunneen, Waldwick, NJ (US)

(73) Assignee: B&G PLASTICS, INC., Union, NJ (US)

( * ) Notice: Subject to any disclaimer, the term of this patent is extended or adjusted under 35 U.S.C. 154(b) by 0 days.

(21) Appl. No.: 14/613,697

(22) Filed: Feb. 4, 2015

(65) Prior Publication Data

US 2015/0235537 A1 Aug. 20, 2015

Related U.S. Application Data

(60) Provisional application No. 61/939,924, filed on Feb. 14, 2014.

(51) Int. Cl.
*G08B 13/14* (2006.01)
*G08B 13/24* (2006.01)

(52) U.S. Cl.
CPC ..... *G08B 13/2434* (2013.01); *G08B 13/2417* (2013.01)

(58) Field of Classification Search
CPC ..... G08B 13/2417; G08B 13/2434
See application file for complete search history.

(56) References Cited

U.S. PATENT DOCUMENTS 3,466,774 A * 9/1969 Borresen ..... G09F 3/18 206/232
D266,774 S * 11/1982 Brown ..... D20/41
4,601,255 A * 7/1986 Marcotti ..... G09F 17/00 116/173
4,656,767 A * 4/1987 Tarrant ..... G09F 3/04 174/112
4,680,882 A * 7/1987 Watson, Jr. ..... G09F 11/23 292/307 R
4,773,612 A * 9/1988 Futrell, II ..... B65H 75/406 242/396.1
D321,913 S * 11/1991 Wolff ..... D20/22
D325,400 S * 4/1992 Wolff ..... D20/22
5,241,982 A * 9/1993 Taylor ..... B60H 3/00 137/384
D342,098 S * 12/1993 Wolff ..... D20/27
D358,615 S * 5/1995 Cline ..... D20/22
D378,221 S * 2/1997 Issler ..... D20/22
D384,701 S * 10/1997 Wolff ..... D20/24
D390,275 S * 2/1998 Wolff ..... D20/22
D392,684 S * 3/1998 Wolff ..... D20/24
D403,708 S * 1/1999 Wolff ..... D20/25
D407,453 S * 3/1999 Rashman ..... D20/27

(Continued)

*Primary Examiner* — Quang D Pham
(74) *Attorney, Agent, or Firm* — Hoffmann & Baron, LLP

(57) ABSTRACT

A security tag for mounting on a handle of a container such as a paint can or plastic pail includes a tag housing having a tubular configuration and a lumen extending through the housing. The housing further includes a flange extending radially outwardly from the tubular housing. The flange is adapted to receive a security device, such as an electronic article surveillance tag or an RFID tag. The security tag includes a cover mounted to the flange to encapsulate the security device. The security tag may be placed onto, e.g., a wire loop handle prior to mounting the handle to the container.

14 Claims, 6 Drawing Sheets

(56) References Cited

U.S. PATENT DOCUMENTS

D412,938 S * 8/1999 Kesselring ..... D20/28
5,933,995 A * 8/1999 Gorbach ..... G09F 3/0289 206/806
D421,773 S * 3/2000 Yashar ..... D20/42
D422,640 S * 4/2000 Carroll ..... D20/23
6,189,249 B1 * 2/2001 Hughes ..... A44B 19/301 24/387
7,322,135 B2 * 1/2008 Gulati ..... G09F 3/00 181/131
7,360,665 B1 * 4/2008 Hartelius ..... B65D 25/32 220/559
RE43,415 E * 5/2012 Tuttle ..... G06K 19/07798 190/101
2004/0079458 A1 * 4/2004 Maeng ..... A63B 60/62 150/160
2006/0053845 A1 * 3/2006 Benda ..... E05B 67/006 70/18
2006/0186210 A1 * 8/2006 Tethrake ..... G06K 19/005 235/492
2006/0187064 A1 * 8/2006 Zovic ..... A45C 13/18 340/572.9
2007/0012772 A1 * 1/2007 Cooper ..... E05B 73/0017 235/435
2007/0120381 A1 * 5/2007 Ehrensvard ..... G08B 13/1445 292/307 R
2007/0159337 A1 * 7/2007 Tethrake ..... G06K 19/041 340/572.8
2007/0214691 A1 * 9/2007 Olsen ..... G09F 3/14 40/300
2008/0218353 A1 * 9/2008 Fellows ..... E05B 45/06 340/572.6
2008/0266111 A1 * 10/2008 Shute ..... G09F 3/0358 340/572.9
2008/0266761 A1 * 10/2008 Robinson ..... G01R 11/04 361/664
2009/0064472 A1 * 3/2009 Olsen ..... A01K 11/00 24/711.1
2009/0091144 A1 * 4/2009 Debrody ..... G09F 3/0317 292/327
2010/0188227 A1 * 7/2010 Yang ..... G08B 13/1463 340/572.1
2010/0327710 A1 * 12/2010 Kolton ..... G06K 19/07762 312/223.1
2011/0068921 A1 * 3/2011 Shafer ..... G06K 7/0008 340/571
2011/0095089 A1 * 4/2011 Kolton ..... G06K 19/041 235/492
2011/0102179 A1 * 5/2011 Ezzo ..... E05B 73/0017 340/568.1
2011/0259991 A1 * 10/2011 Goldstein ..... E05B 45/005 242/388
2012/0019385 A1 * 1/2012 Brodzik ..... G08B 13/2434 340/572.9
2012/0050042 A1 * 3/2012 Shute ..... G08B 13/2408 340/572.1
2012/0055209 A1 * 3/2012 Conti ..... E05B 45/005 70/15
2012/0073155 A1 * 3/2012 Mabey ..... G01B 3/1005 33/770
2012/0083658 A1 * 4/2012 Hahn ..... A61B 1/32 600/205
2012/0210755 A1 * 8/2012 Shafer ..... E05B 73/0005 70/15
2012/0227446 A1 * 9/2012 Shute ..... E05B 45/005 70/15
2013/0020217 A1 * 1/2013 Alexander ..... B65D 73/0071 206/349
2013/0057387 A1 * 3/2013 Binmore ..... B23B 51/08 340/10.1
2013/0098122 A1 * 4/2013 Eckert ..... G08B 13/1445 70/15
2015/0027176 A1 * 1/2015 Todd, II ..... E05B 65/0089 70/167
2015/0259951 A1 * 9/2015 Nazzari ..... G09F 3/0364 70/15

* cited by examiner

SECURITY TAG FOR WIRE HANDLE

This application claims priority to U.S. Provisional Application Ser. No. 61/939,924 filed on Feb. 14, 2014, the disclosure of which is incorporated herein by reference in its entirety.

FIELD OF THE INVENTION

The present invention relates generally to merchandise security and/or inventory control tags, and particularly to a security and/or inventory control tag which can be attached to a plastic, rope or wire loop handle on a container or pail.

BACKGROUND OF THE INVENTION

The invention relates to a security tag to detect if merchandise is being taken without payment and/or to track store inventory levels. Many different types of merchandise are packaged in containers or pails which use a plastic, rope or wire loop type handle to carry the container. An example of such a container includes paint cans made of both metal and plastic, e.g., a one gallon container made of metal and a five gallon container made of plastic. In order to protect merchandise from theft, many retailers use electronic article (EAS) tags affixed to the goods. Alternatively, the tag may include an RFID label which can be used to monitor inventory levels in the store.

SUMMARY

There is a need for a security device which can be easily mounted to a container having a plastic, rope or wire loop handle.

It is an object of the invention to provide a security tag which can be mounted to a plastic, rope or wire loop handle of a container, such as a paint can or pail.

It is a further object of the invention to provide a security tag for a plastic, rope or wire loop handle of a container which makes the container easier to carry, yet helps to protect against theft of the container.

The above and other objects of the invention are realized by the invention described below. The security tag formed in accordance with the invention is adapted to be mounted on a wire handle for a container. The security tag includes a tag housing having an elongate generally tubular body and having a lumen extending through the housing. The housing body further includes a flange extending radially outward from the housing body. The flange includes an area adapted to receive a security device, such as an electronic article surveillance (EAS) device or an RFID tag. A cover is provided to be mounted to the flange to encapsulate the security device therein and prevent removal by a consumer. The cover may be ultrasonically welded or adhesively affixed to the flange. Furthermore, the flange may include a recessed bezel designed to receive the cover. The recessed bezel provides a ledge upon which the cover can be mounted. The flange and cover include an area upon which indicia may be provided. Such indicia may include product information, a brand logo, a security device warning or a bar code.

The security tag when mounted on the wire, plastic or rope handle provides a comfortable handle for the user to hold. Since the merchandise in the container may be heavy, the security tag may include strengthening ribs provided on the tag housing. The strengthening ribs may be provided at both ends of the tag housing as well as in the middle thereof.

The side of the housing opposite the flange may include a series of waves to provide a gripping surface which conforms to the consumer's fingers. The security tag housing may be integrally formed as single piece via any type of molding process, such as injection molding. The cover is preferably molded as a separate component piece.

In an alternative embodiment, the security tag includes a housing body comprising a main body having two wings hingedly attached thereto. The wings are coupled to the main body by a living hinge, each wing including an engagement member which extends radially outward from the security tag when the wings are in a closed position. The engagement members include facing surfaces and a security device, such as an EAS device or RFID tag which is sandwiched between the engagement members in the closed position. The engagement members are held in the closed position by any locking means such as a mechanical latch, ultrasonic welding or adhesively bonding. In an open position, the engagement members are spaced apart to receive the security device. Once closed, the security tag prevents the non-destructive removal of the security device from the security tag.

BRIEF DESCRIPTION OF THE DRAWINGS

The above and other features and advantages of the invention will become apparent from a consideration of the following detailed description when reviewed in connection with the accompanying drawings, in which.

DETAILED DESCRIPTION

Figure 1:
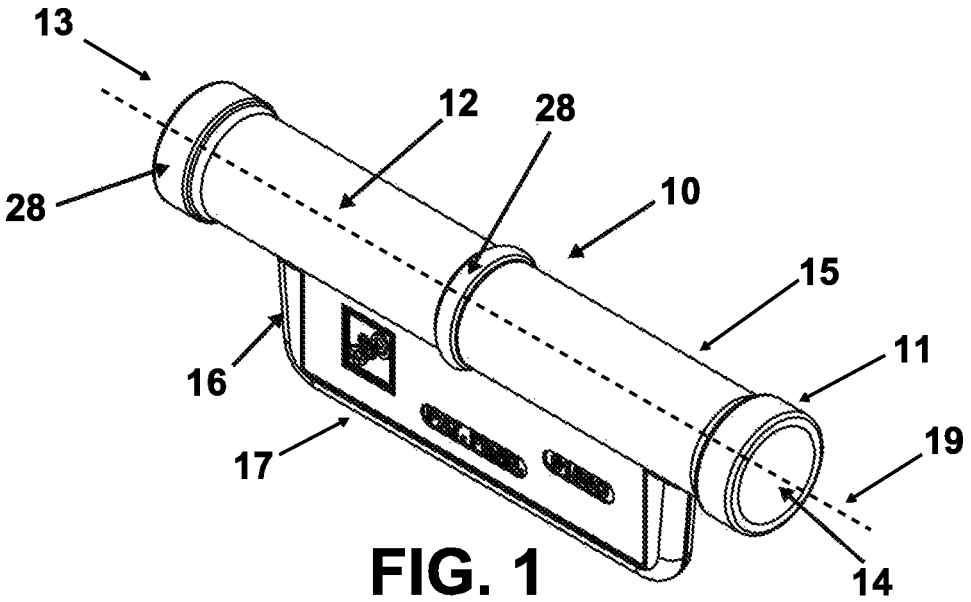
FIG. 1 is a perspective view of a first embodiment of the security tag formed in accordance with the present invention.

As shown in FIG. 1 the security tag 10 of the present invention includes an elongated housing body 12 having a lumen 14 extending therethrough. The security tag 10 is adapted to be mounted on a wire loop handle for a container, such as a five gallon plastic paint-type pail. (See e.g. FIGS. 6 and 7). The security tag provides two functions. First, the security tag includes an electronic security device mounted therein, such as an electronic article surveillance (EAS) device as is well known in the industry or an RFID tag used for security and/or inventory monitoring. Second, the security tag provides a larger diameter handle for the consumer to grasp making carrying a heavy pail more comfortable. Without the security tag, the thin wire, plastic or rope handle can cut into the consumer's hand and make transporting the pail difficult.

Figure 2:
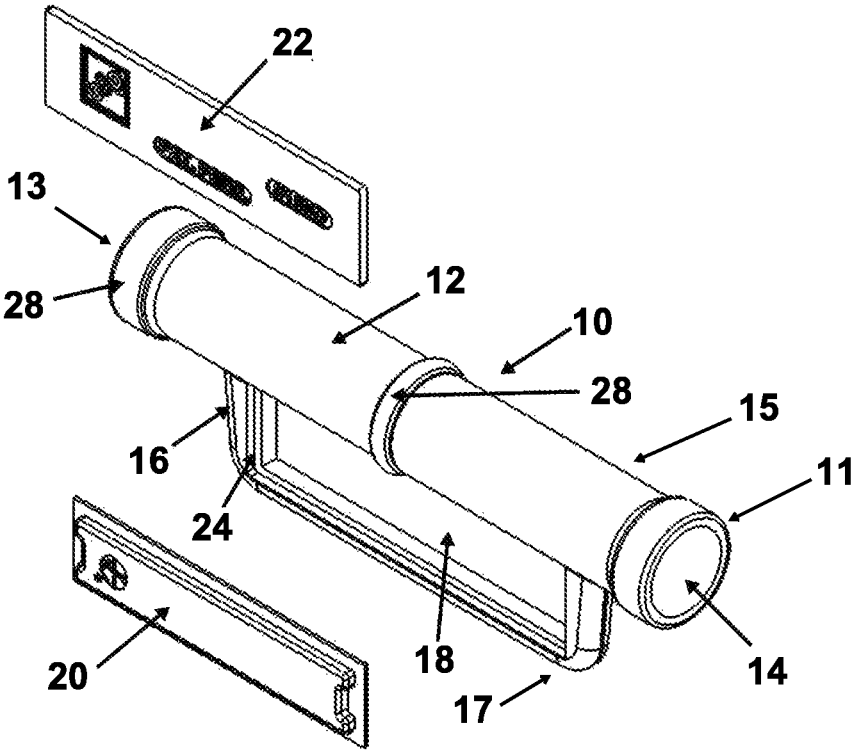
FIG. 2 is an exploded perspective view showing the component parts of the security tag shown in FIG. 1.
Figure 3:
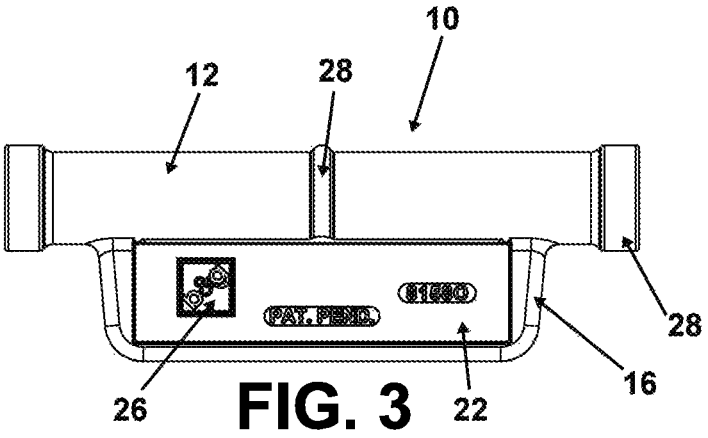
FIG. 3 is a side elevation view of the front of the security tag shown in FIG. 1.

Referring to FIGS. 1-5, the security tag 10 formed in accordance with the present invention also includes a flange 16 extending radially outward from the housing body 12. The housing body 12 has an elongate, generally tubular configuration, an exterior wall 15, a longitudinal axis extending between a first end 11 and a second end 12 and a lumen 14 extending through the housing body 12 between the first and second ends 11, 12 and adapted to receive the handle 3 (see FIG. 6). As shown in FIG. 2, the flange 16 extends radially and outwardly from the exterior wall 15 of the housing body 12 to a distal edge 17 that extends parallel to the longitudinal axis 19. The flange 16 includes a recessed area 18 adapted to receive a security device 20, such as an EAS device or an RFID tag. A cover 22 is provided to be mounted onto the flange 16 to secure and encapsulate the security device 20 therein and prevent removal by the consumer. In a preferred embodiment, the flange 16 includes a recessed bezel 24 which is dimensioned so that the cover fits flush with the exterior wall of the flange as shown by the bottom view of FIG. 7. The recessed bezel provides a ledge upon which the cover is mounted. The cover 22 may be ultrasonically welded or adhesively bonded to the flange 16 to permanently bond the cover to the housing to prevent its removal and protect the security device 20.

Figure 4:
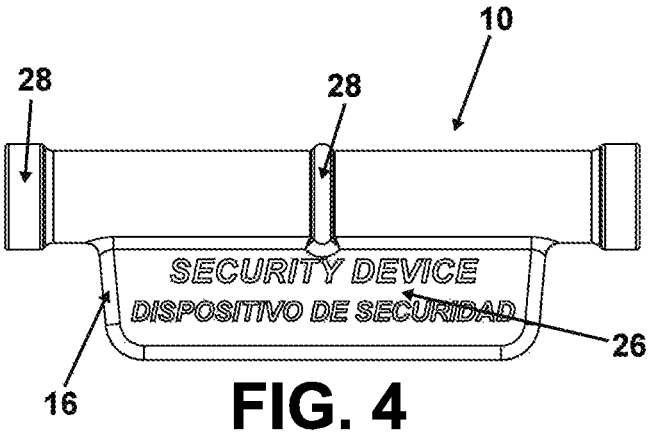
FIG. 4 is a side elevation view of the back of the security tag shown in FIG. 1.
Figure 5:
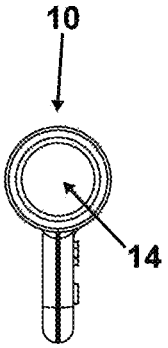
FIG. 5 is an end view of the security tag shown in FIG. 1.

The outer surface of the cover 22 and the outer side surface of the flange 16 opposite the recess include an area upon which indicia 26 may be provided. For example, as shown in FIG. 4, the indicia may include a warning to consumers that the product is provided with a security device. The indicia may also include product information, a brand logo, patent information or a space for placing a sticker which may include, e.g. a bar code or pricing information.

In the embodiment shown in FIGS. 1-5, the security tag housing 12 is preferably made of plastic and is thermoformed. By way of example, the security tag housing 12 and cover 22 may be formed by injection molding, thermoforming, casting, ultrasonically forming and/or made from a plastic or epoxy which can initially flow into a mold and later solidities. Those skilled in the art will appreciate that the security tag may be made from any suitable material using a variety of manufacturing technologies.

As shown in FIGS. 1-5, the security tag housing body 12 may include at least one strengthening rib 28 thereon. The strengthening ribs may be provided anywhere on the housing body. For example, as shown in FIGS. 1-5, the housing body 12 includes three strengthening ribs 28. One rib 28 is provided at a center point and another rib is provided at each end of the body at the lumen opening 14. Thus, the housing is reinforced by a rib at each end in which the wire loop handle is inserted.

Figure 6:
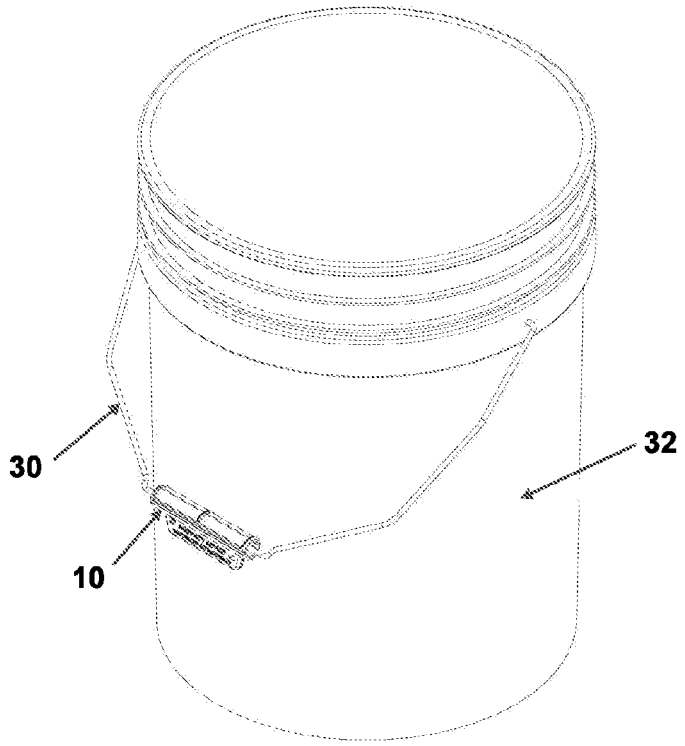
FIG. 6 illustrates the security tag of FIG. 1 mounted on a wire handle of a container in a rest position.
Figure 7:
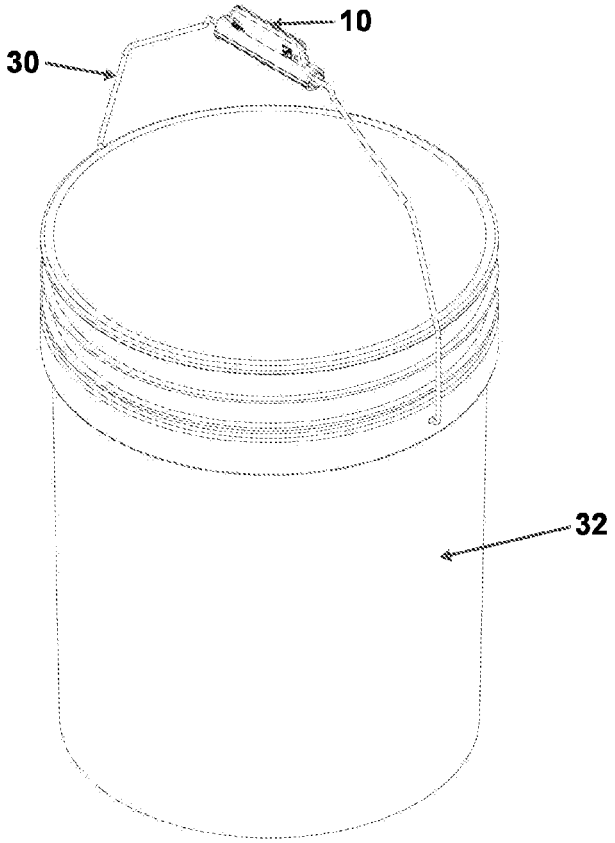
FIG. 7 illustrates the security tag of FIG. 1 mounted on a wire handle of a container in a carrying position.

Referring to FIGS. 6 and 7, the security tag 10 of the present invention is shown installed on a wire loop handle 30 of, for example, a five gallon plastic container 32 typically used for paint, spackle, laundry detergent, etc. Prior to installation of the wire loop handle 30, the manufacturer of the container places the wire handle 30 through the lumen 14 of the security tag. The wire handle 30 is then mounted to the container in the usual way. The security tag 10 provides a means to prevent theft from a retail store and also provides a comfortable handle to carry the container and prevent the wire handle from pressing into the hand of the person carrying the container. The security tag 10 may further include finger grips (not shown) molded into a housing body surface opposite the flange 16 to make transporting the container more comfortable. The finger grips are wave-like structures to accommodate the fingers of the person gripping the security tag to carry the container. See for example, finger grips shown in U.S. Pat. No. D477,506 entitled, "Barbeque Grill Tool With Finger Grips," the disclosure of which is incorporated herein by reference in its entirety.

An alternative embodiment of the security tag formed in accordance with the present invention is shown in FIGS. 8-13. In this embodiment, the security tag 10' includes a tubular housing 40 having an open position (see FIGS. 8-11) and a closed position (see FIGS. 12-13). In the open position as shown in FIGS. 8-11 the tubular housing 40 comprises a plurality of hingedly attached sections wherein two sections include engagement members 42. As shown in FIGS. 8-11, the engagement members extend outwardly from a section of the housing.

The engagement members 42 preferably include facing surfaces 44 which engage to hold the security tag in the closed position. The engagement members 42 may include interlocking elements 46, such as interlocking fingers to hold the engagement members in the closed position. The interlocking elements 46 may be provided with a one-way latching system which locks the engagement members together and prevents them from being opened. Alternatively, the engagement members may include ultrasonic welding energy directors 48 on the engaging surfaces 44, the engagement members being ultrasonically welded into the closed position.

As shown in FIGS. 8-11, the housing sections on which the engagement members are provided are hingedly attached to the housing main body 50 via a living hinge 52 made during the molding process. One or both of the facing surfaces 44 of the engagement members 42 preferably include a slot or receiving opening 54 adapted to receive and hold a security device 56, such as an EAS device or RFID tag. Thus, when placed into the closed position, the security device 56 is locked into place between the engagement members 42.

Figure 8:
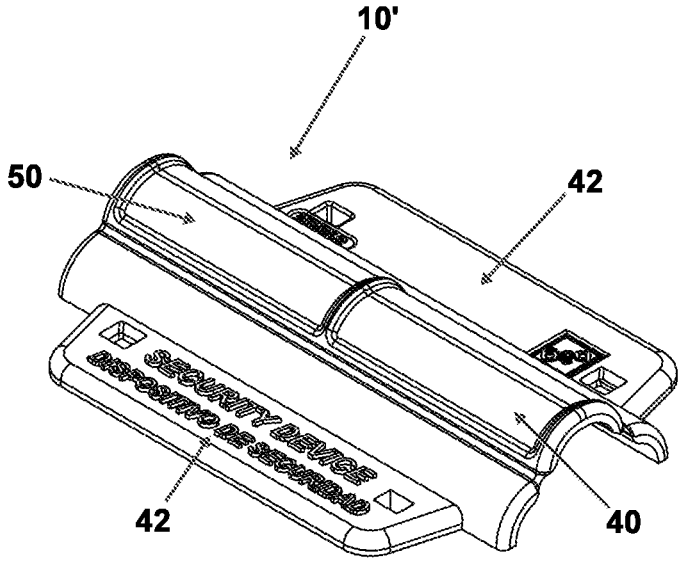
FIG. 8 is a perspective view of a second embodiment of a security tag formed in accordance with the present invention in an open position.
Figure 9:
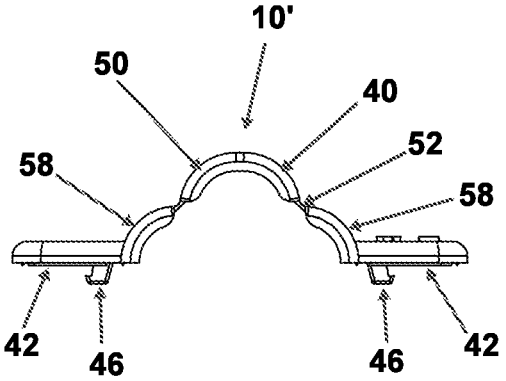
FIG. 9 is an end view of the security tag shown in FIG. 8.
Figure 10:
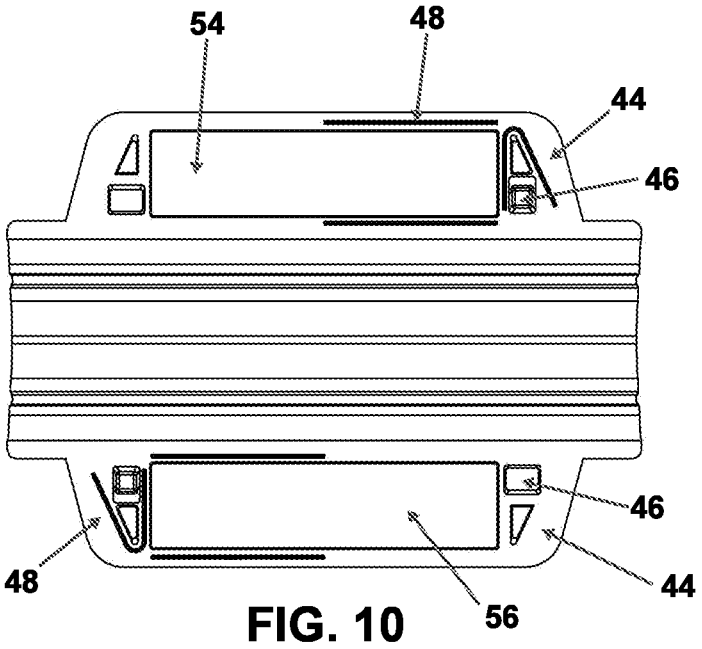
FIG. 10 is a bottom plan of the security tag shown in FIG. 8.
Figure 11:
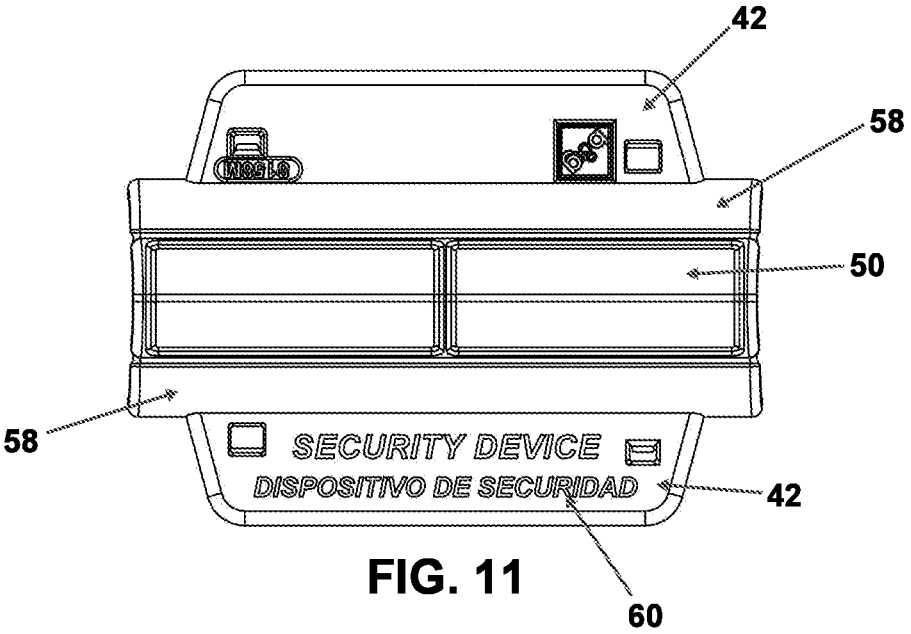
FIG. 11 is a top plan view of the security tag shown in FIG. 8.

As shown in FIGS. 8 and 9, the tubular housing body includes a main body 50 having two wings 58 hingedly attached thereto. The wings 58 are moveable between an open and closed position. The engagement members preferably extend outwardly from the wings so that they are substantially perpendicular to the tubular housing in the closed position. Similar to the embodiment show in FIGS. 1-5, the embodiment shown in FIGS. 8-13 may include indicia 60 on outer surfaces of the engagement members 42.

Figure 12:
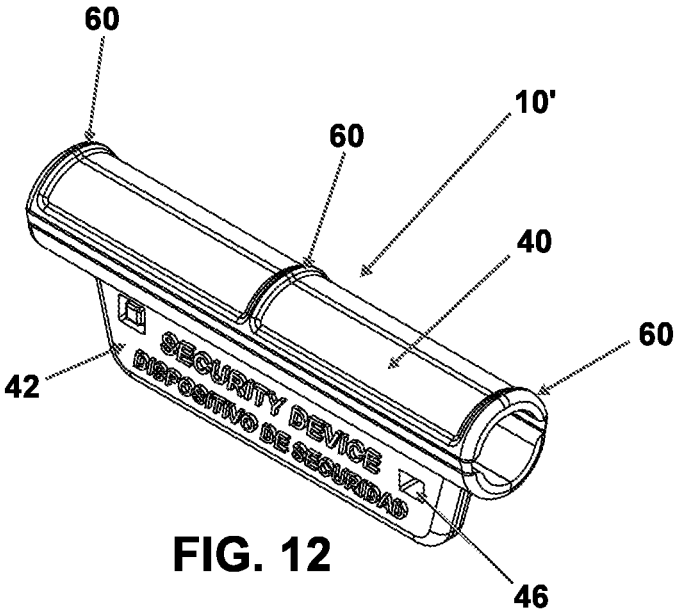
FIG. 12 is a perspective view of the second embodiment of the security tag shown in FIG. 8 in a closed position.
Figure 13:
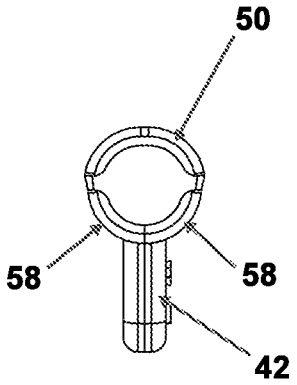
FIG. 13 is an end view of the security tag shown in FIG. 12.

FIGS. 12 and 13 illustrate the security tag 10' in the closed position. As discussed above, the security device 56 is locked into position between the engagement members 42. The housing main body 50 may also include strengthening ribs 60 as shown in FIGS. 12 and 13. In this embodiment, a strengthening rib 60 is provided at each end of the housing main body as well as one in the middle of the housing.

As shown in FIG. 13, the housing main body 50 extends over approximately half of the tag housing and each wing 58 extends over approximately one quarter of the tag housing. Thus, when in use and installed on a wire handle, the wire loop handle will be supported on the housing main body in an area where there are no hinges.

Preferably, the security tag 10' is fully assembled in the closed position and inserted onto the plastic, rope or wire loop handle during the manufacturing process of the container. Alternatively, the security tag 10' may be placed onto the handle in the open position, a security device inserted into the slot in the engagement members and the wings moved into a closed, locked position.

Thus, while these have been described the preferred embodiments of the present invention, those skilled in the art will realize that other embodiments can be made without departing from the spirit of the invention, and it is intended to include all such further modifications and changes as coming within the scope of claim set forth herein.

What is claimed is:

1. A security tag for mounting on a handle provided on a container, the security tag comprising:

an integrally formed, one-piece, non-hinged security tag housing having an elongate, generally tubular configuration, an exterior wall, a longitudinal axis extending between a first end and a second end and a lumen extending through the housing between the first and second ends and adapted to receive the handle, the housing further including a flange intermediate the first and second ends and extending radially and outwardly from the exterior wall of the housing to a distal edge that extends parallel to the longitudinal axis of the housing, the flange including an area adapted to receive a security device comprising at least one of an electronic article surveillance device and an RFID tag to protect the container from theft and a recessed bezel providing a ledge which dimensions so that a separate cover fits flush with the exterior wall of the housing; and the separate cover sealingly mounted to the flange to encapsulate the security device, and wherein the housing includes at least one external strengthening rib and the lumen is substantially smooth.

2. The security tag as defined in claim 1, wherein the cover is sealingly mounted to the flange via one of ultrasonically welding and adhesively bonding.

3. The security tag as defined in claim 1, wherein the handle is made from one of plastic, rope and wire.

4. The security tag as defined in claim 1, wherein the tag housing includes molded finger grips thereon opposite the flange.

5. The security tag as defined in claim 4, wherein the indicia comprises a logo, product information, a security device warning, or a bar code.

6. The security tag as defined in claim 1, wherein each end of the tag housing includes an external strengthening rib.

7. A security tag for mounting on an article including an elongate carrying handle, the security tag comprising:

a tag housing having an elongate generally tubular housing body having a length, an exterior circumference, a first end, a second end and a longitudinal axis extending between the first and second ends, and comprising a main body portion and two wing portions extending between the first and second ends, and each of the two wing portions having first and second sides, wherein the first side of each wing is hingedly attached to opposite sides of the main body portion via first and second living hinges, each living hinge extending between the first and second ends, wherein the two wings are movable between an open position and a closed position, wherein, in the closed position, the second sides of the wings are in contact with each other and, together with the main body portion, form a lumen extending through the tubular housing body, wherein the lumen is adapted for mounting on said handle, and wherein the main body comprises approximately half of the exterior circumference of the tubular housing body and each wing comprises approximately one quarter of the exterior circumference of the tubular housing body;

a pair of engagement members extending from the second side of each of the two wings, wherein the pair of engagement members extend radially from said tubular housing body and are lockingly engageable at mating facing surfaces thereof in said closed position thereby preventing non-destructible removal of said housing from said handle, wherein each mating facing surface has a receiving opening therein; and a security device comprising at least one of an electronic article surveillance device and an RFID tag to protect the article from theft, the security device being mounted in the receiving openings in the mating facing surfaces of said engagement members to be non-accessibly positioned between said engagement members in said closed position.

8. The security tag of claim 7, wherein said engagement members each include interlocking elements for securing one engagement member to the other engagement member.

9. The security tag of claim 7, wherein said engagement members are ultrasonically welded together to form the closed position.

10. The security tag of claim 7, wherein the handle is one of a wire, plastic, and rope handle provided on a container.

11. The security tag of claim 7, wherein the engagement members extend radially outward from the wings in the closed position.

12. The security tag of claim 7, wherein the pair of engagement members extend substantially perpendicular to the tubular housing.

13. The security tag of claim 7, wherein the pair of engagement members include outer surfaces for providing indicia thereon, the indicia comprising a bar code, product information, logo, or security device warning.

14. The security tag of claim 7, wherein the tubular housing includes at least one strengthening rib on an external surface thereof.

* * * * *